United States Patent [19]

Dougherty Patrick F. et al.

[11] Patent Number: 4,955,608

[45] Date of Patent: Sep. 11, 1990

[54] ATHLETIC MOVEMENT TRAINER

[76] Inventors: Patrick F. Dougherty; Chris A. Ashby, both of 2615 N. Causeway Blvd., Mandeville, La. 70448

[21] Appl. No.: 310,299

[22] Filed: Feb. 13, 1989

[51] Int. Cl.[5] ..... A63B 69/00

[52] U.S. Cl. ..... 273/29 A; 273/26 C; 273/188 R; 273/188 A; 273/183 B; 273/DIG. 19; 272/116; 272/119; 272/137

[58] Field of Search ..... 273/29 A, 29 R, DIG. 5, 273/188 R, 183 B, DIG. 19, 26 C, 189, 190; 272/70, 139, 137, 136, 143, 142, 94, DIG. 4, 119, 116

[56] References Cited

U.S. PATENT DOCUMENTS

| | | | |
|---|---|---|---|
| Re. 325,547 | 11/1987 | Reet et al. | 272/139 |
| 1,402,179 | 1/1922 | Piscitelli | 272/139 |
| 1,677,728 | 7/1928 | Robinson . | |
| 2,097,376 | 10/1937 | Marshman | 272/80 |
| 2,498,006 | 2/1950 | Ridill | 273/35 |
| 2,893,736 | 7/1959 | Tesi | 273/188 |
| 3,059,932 | 10/1962 | Smallwood | 273/190 |
| 3,940,144 | 2/1967 | Dickie | 273/183 |
| 3,999,752 | 12/1976 | Kupperman et al. | 273/DIG. 19 |
| 4,134,589 | 1/1979 | Arena | 273/183 |
| 4,359,221 | 11/1982 | Taylor | 273/54 B |
| 4,396,190 | 8/1983 | Wilkerson | 273/DIG. 5 |
| 4,544,155 | 10/1985 | Wallenbrook, et al. . | |
| 4,685,671 | 8/1987 | Hagerman | 272/139 |
| 4,815,731 | 3/1989 | Suarez et al. | 272/139 |

OTHER PUBLICATIONS

Dawidoff, Nicholas, "Playing Ball and Chain," *Sports Illustrated,* p. 81, May 22, 1989.

*Primary Examiner*—Theatrice Brown
*Attorney, Agent, or Firm*—Kilpatrick & Cody

[57] ABSTRACT

An athletic movement trainer comprising a belt, ankle straps, and an elasticized, bungee-type cord. The cord passes through a ring, such as a screw eye, attached to the belt. Each end of the cord is adjustably connected to an ankle strap so that the cord will remain relaxed as long as the sportsman maintains the proper athletic position but will become tensioned when the athlete deviates from the correct posture or stance. Because the ring does not prevent all movement of the cord, the trainer merely resists, rather than restricts, the upward movement of the athlete. The trainer thereby "reminds" the sportsman to resume the proper athletic position without preventing him or her from deviating from the position when required.

7 Claims, 2 Drawing Sheets

ATHLETIC MOVEMENT TRAINER

This invention relates to a device for use in teaching athletes, particularly tennis players, to maintain proper positioning of the lower body for improved performance during practice and competition.

BACKGROUND OF THE INVENTION

Development of proper lower body movement techniques serves as a foundation for optimum performance in virtually all movement-based sports. Whether an athlete is positioned in the batter's box awaiting a rapidly approaching fastball, in the lane anticipating the rebound from a missed field-goal attempt, or at the baseline expecting a powerful serve, his or her ultimate success in responding to the anticipated event depends in great measure upon the proper positioning of the lower body. While instructors of students of the various sports long have recognized the importance of teaching suitable lower body movement behavior habits to their pupils, they previously have been forced to do so only through observing each pupil and illustrating the proper techniques once the contest or event has been completed.

Because demonstrative, after-the-fact feedback from a coach or instructor does not always produce satisfactory results for players needing constant reminders to develop good positioning habits, the sporting industry has turned to mechanical teaching aids to improve performance. For example, a wide variety of tools have been created to assist golfers in learning and developing proper swinging techniques. U.S. Pat. Nos. 2,893,736 and 3,940,144 disclose two such devices, which act as positioning means ensuring proper placement of the feet, flexing of the knees, and swiveling of the hips during various golfing strokes. While each of these teaching tools is designed for use or is capable of being utilized while a golfer is actually on the course participating in a practice or competitive round, neither device contemplates use when rapid foot movement is required for extended periods of time. Of course, such footwork is neither necessary nor desirable while playing golf.

Other sports, however, such as baseball, basketball, tennis, and volleyball, demand extensive rapid lower body movement during numerous phases of the games. Athletes desiring to enhance their performance in these sports must learn to maximize the efficiency and fluidity of their leg movements and to maintain correct weight distributions and positioning of the feet and knees. For these athletes no device has previously been developed to teach proper lower body movement techniques while they are practicing or competing.

SUMMARY OF THE INVENTION

The athletic movement trainer of the present invention provides a simple, easy to use device which firmly but gently "reminds" a student to maintain proper positioning of the lower body. Because the device is designed to avoid restricting the student's freedom of movement it may be worn constantly during practice or competition, even when rapid lower body movement is required. Consequently, the trainer described here is adaptable for use by athletes competing in a wide variety of movement-based sports.

The present invention consists of three basic parts: a belt worn about the waist of the athlete; ankle straps worn about the ankles; and an elastic, bungee-type cord which passes freely through a ring positioned at the back of the belt and connects the straps. Features of the belt include cellular foam padding for a more comfortable fit and vinyl coating of its exterior surfaces to resist the absorption of perspiration and enhance durability. An adjustable clip structure attached near each end of the cord permits adjustment of the cord length depending upon the height of the athlete and the type of movement to be taught and also functions to attach the cord to the straps. Hook and loop fasteners on the ankle straps allow for adjustable placement of the straps about the ankles, and sturdy nylon loops receive the clips of the cord.

The movement trainer is designed to be put on the wearer quickly and easily. To utilize the device the athlete merely buckles the belt about the waist, attaches a strap to each ankle, and clips one end of the cord to each strap. The cord then may be adjusted so that it remains slack while the athlete maintains the appropriate athletic position, generally with knees flexed, but becomes tensioned when the athlete deviates from that position. The elastic resistance of the cord gently "reminds" the sportsman in such a situation that an improper body movement technique is being used. Because the cord merely resists movement rather than restricting it as an isometric exerciser might do, the device of the present invention may be worn even when the athlete must perform movements that necessarily tension the cord.

The athletic movement trainer described herein assists the athlete in developing a variety of favorable techniques for positioning and moving the lower body. The present invention encourages the athlete to maintain a lower center of gravity and helps to improve balance by causing the athlete to distribute much of the body weight on the balls of the feet. Lessened reaction and recovery time and increased fluidity of movement also may occur due to a decrease in the energy and motion needed to move from one place to another while practicing or competing. The trainer of the present invention helps develop the lower body muscle groups, resulting in increased strength and endurance, and assists the athlete in maintaining proper hitting stances particularly in racquet sports such as tennis and racquetball. These players also may improve the power and control of their strokes because of the more stable support base encouraged through use of the athletic movement trainer to properly position the feet.

It is therefore an object of the present invention to provide an athletic movement trainer that "reminds" an athlete to maintain proper positioning of the lower body.

It is an additional object of the present invention to provide an athletic movement trainer that is simple and easy to use.

It is a further object of the present invention to provide an athletic movement trainer that does not substantially restrict the movement of the sportsman and is adaptable for use by athletes engaged in a wide variety of movement-based sports.

Other features and objects of the invention will become apparent from reference to the detailed description of the invention and the accompanying drawings.

DETAILED DESCRIPTION OF THE DRAWINGS

Figure 1:
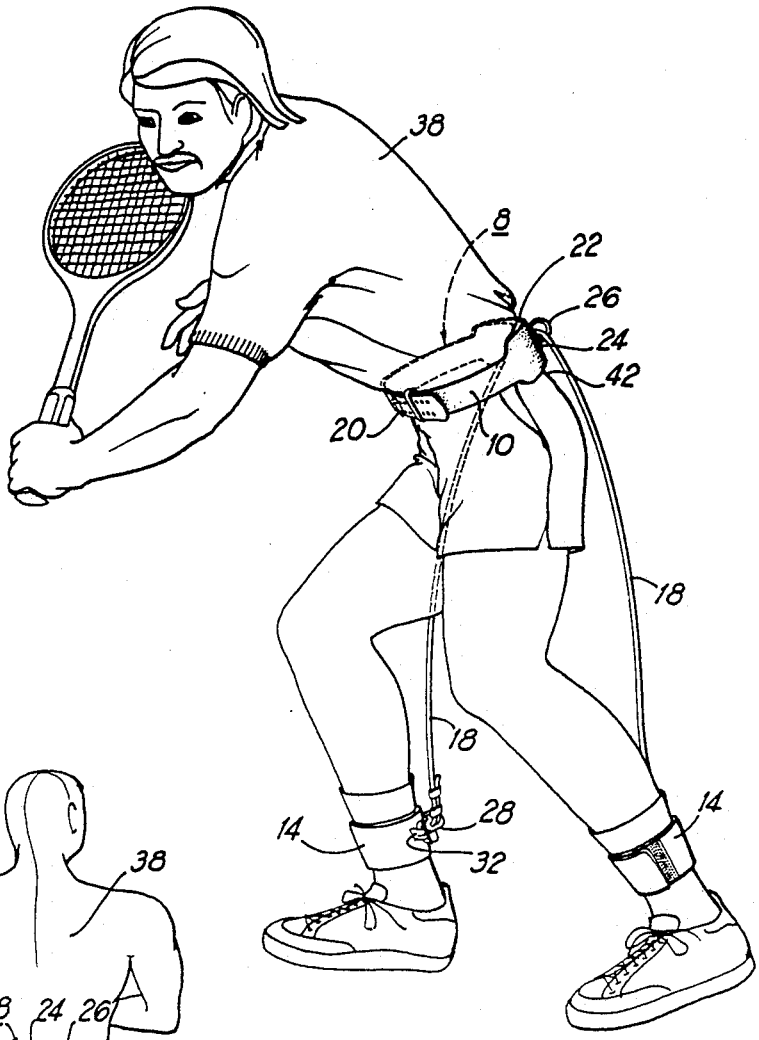
FIG. 1 is a perspective view illustrating the athletic movement trainer as it would normally be used to teach an athlete to maintain certain positioning of the lower body.
Figure 2:
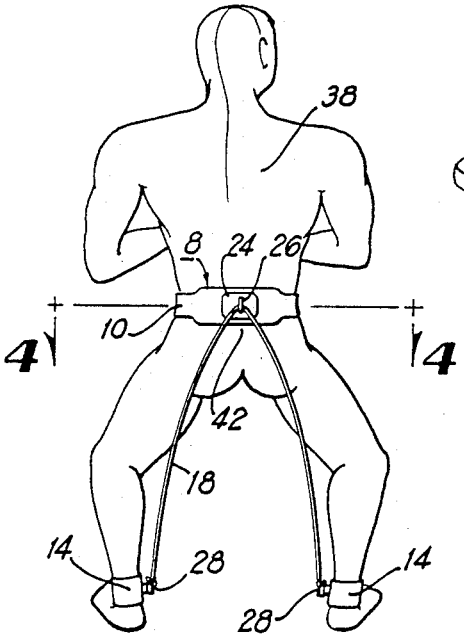
FIG. 2 is a rear elevational view of the athletic movement trainer shown in FIG. 1 connected to a human body.
Figure 3:
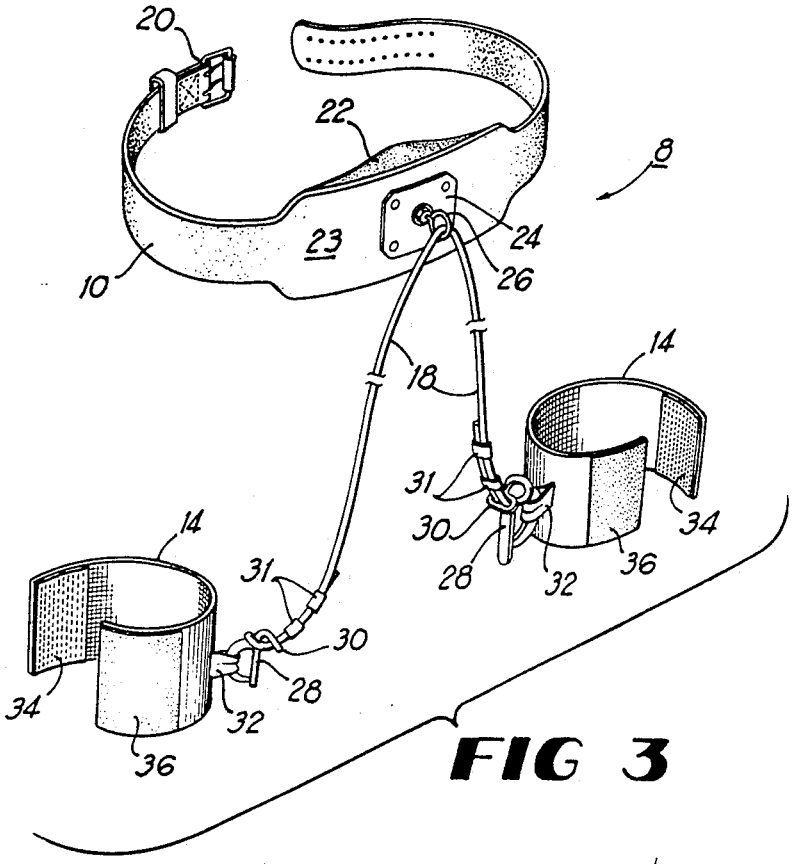
FIG. 3 is a perspective view of the athletic movement trainer shown in FIG. 1.
Figure 4:
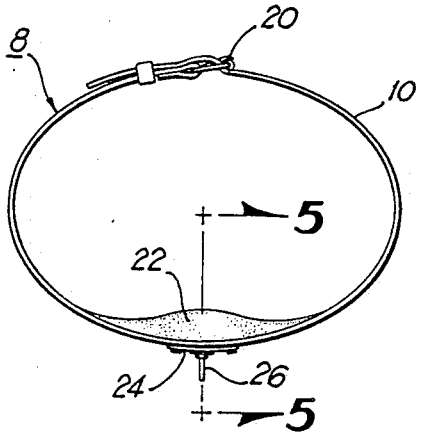
FIG. 4 is a top view of the belt of the athletic movement trainer taken along lines 4—4 in FIG. 2.

Referring principally to FIGS. 1-3, the athletic movement trainer 8 of the present invention consists of a belt 10 to be worn around the waist, straps 14 to be worn around the ankles, and an elasticized cord 18 serving to connect belt 10 to straps 14 as shown. Belt 10 typically is made of leather, includes a conventional fastening means such as a buckle 20 for fastening about the waist, and embodies a cellular foam padding 22 (FIGS. 3-5) designed to conform to the curvature of the lumbar region of the back. Belt 10 also may be coated with liquid vinyl 23 (FIGS. 3 and 5) to prevent it from absorbing perspiration produced by the athlete's body.

Figure 5:
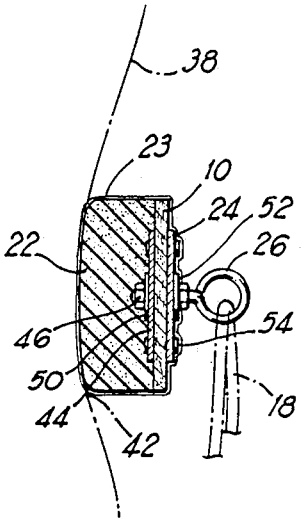
FIG. 5 is a cross-sectional view of the belt taken along lines 5—5 in FIG. 4.

Protruding outward from the center rear portion of belt 10 and anchored to belt 10 by rectangular metal plates 24 and 44, nuts 46 and 48, washers 50 and 52, and rivets 54, is a ring 26, such as a conventional screw eye (FIG. 5). Ring 26 has an inner diameter larger than the diameter of cord 18, so that the cord 18 may pass freely through it. Plates 24 and 44 also serve to distribute the downward forces present on ring 26 over a greater surface area, decreasing the wear on the ring 26 while trainer 8 is in use. Of course, those skilled in the art will recognize that belt 10 could include a variety of rings and anchoring means different from those specifically described and illustrated. For example, ring 26 could be welded to plates 24 and 44 (or to a single plate). Alternatively, ring 26 and plates 24 and 44 (or a single plate) could be molded from a single piece of plastic, avoiding the need to attach ring 26 to plates 24 and 44 in a separate manufacturing step.

Anchoring clips 28 (FIG. 3) attached near each end of cord 18 serve both as a mechanism for attaching the cord 18 to ankle straps 14 and as a means for adjusting the working length of the cord 18. Each end of cord 18 may be passed through a retaining loop 30 connected to clip 28, looped back upon itself, and passed back through loop 30 until the unneeded section of cord 18 extends beyond the loop 30. Because loop 30 has an opening slightly less than twice the size of cord 18, the cord 18 must be forced back through the loop 30 and therefore is secured in place while trainer 8 is in use. Additional retaining loops 31 may be used to prevent the section of cord 18 extending beyond loop 30 from fluttering while the trainer 8 is utilized. Receiving loops 32 of ankle straps 14 receive clips 28, connecting each end segment of cord 18 to a strap 14. Straps 14 also include hook 34 and loop 36 fasteners for attaching the straps 14 to the ankles, although other suitable fastening means may be used instead.

FIGS. 1 and 2 illustrate the present invention as it would be used by an athlete 38. To utilize trainer 8, athlete 38 initially attaches belt 10 around the waist using buckle 20 so that ring 26 through which cord 18 passes is positioned directly above the tail bone 42. Athlete 38 then attaches an ankle strap 14 to each of the left and right ankles with its receiving loop 32 positioned behind the ankle directly over the achilles tendon (not shown). Grasping one end of cord 18, athlete 38 connects its corresponding clip 28 to a receiving loop 32, thus securing one end of cord 18 to an ankle strap 14. Athlete 38 then merely grasps the other end of cord 18 and connects its clip 28 to the other receiving loop 32. Because trainer 8 is designed to become tensioned when the sportsman is in certain positions, athlete 38 may need to relax the tension in cord 18 by, for example, squatting, before attaching clips 28 to loops 32.

Athlete 38 also may increase or decrease the desired tension in cord 18 by changing its length using adjustable clips 28 (FIG. 3). To obtain the proper length of cord 18 for a tennis player desirous of establishing proper lower body movement habits, the athlete 38 should stand with feet spread approximately one and one-half to two shoulder widths apart and knees bent to a comfortable position. Once athlete 38 has established this position, the length of cord 18 should be adjusted so that very little slack remains but cord 18 has not yet become tensioned.

Adjusting cord 18 in this manner allows trainer 8 to become tensioned when athlete 38 attempts to straighten his knees, thus "reminding" him by resisting his upward movement that the proper position for preparing to return a tennis volley will be with knees bent. By gently forcing athlete 38 to keep his knees flexed, trainer 8 encourages maintenance of a lower center of gravity, better balance through improved distribution of weight, and development of the lower body muscle groups. However, because cord 18 is made of elasticized material, trainer 8 will not restrict the movement of athlete 38 when deviation from the proper athletic position is required, such as when the athlete 38 must run to reach a stroked or batted ball. Although cord 18 could consist of two cord segments, each connected to an ankle strap 14 and to the back of belt 10, use of a single cord 18 passing freely through ring 26 of belt 10 exploits the alternative flexing of the knees which occurs while athlete 38 is running. Because one knee is flexed when the other is locked, slack in one section of cord 18 created by the flexing of the knee can be transferred to the segment corresponding to the locked knee merely by allowing cord 18 to pass through ring 26. Utilizing a single cord 18 thus results in less overall restriction of movement while athlete 38 races to reach the ball.

The foregoing is provided for purposes of illustration, explanation and description of the present invention. Modifications to and adaptations of the invention will be apparent to those of ordinary skill in the art and may be made without departing from its scope or spirit.

We claim:

1. A device for aiding the training of an athlete comprising:

a. first and second straps for placement about the ankles of an athlete;

b. an elongated, elasticized member having two ends;

c. means for receiving the elongated member, the receiving means including an opening with an interior of a size greater than the transverse dimension of the elongated member for allowing unrestricted passage of the elongated member through the opening;

d. means for positioning the receiving means at an athlete's waist near the center of an athlete's back; and the elongated member is received by the opening one end is connected to the first strap and the other end is connected to the second strap when the device is worn by an athlete.

2. A device according to claim 1 in which the positioning means comprises:

a. a belt for placement about an athlete's waist; and b. a plate attached to the belt.

3. A device according to claim 2 in which the receiving means is a ring rigidly connected to the plate.

4. A device according to claim 3 in which the belt comprises:

a. cellular foam padding; and b. vinyl coating.

5. A device for aiding the training of an athlete comprising:

a. an elongated, elasticized member having two ends and a predetermined length for providing a pulling force between an athlete's waist and an athlete's ankles when the device is worn by an athlete;

b. a clip removably attached near each end of the elongated member;

c. means for adjusting the length of the elongated member between the clips;

d. a pair of ankle straps, each strap for placement about an ankle of an athlete and for attachment to a clip when the device is worn by an athlete;

e. a belt for placement about the waist of an athlete;

f. a plate at least partially embedded in the belt; and g. a ring rigidly connected to the plate, the ring having an interior size greater than the transverse dimension of the elongated member for allowing unrestricted passage of the elongated member through the ring and positioning at least a portion of the elongated member near the center of an athlete's back when the device is worn by an athlete.

6. A device according to claim 5 in which the adjusting means comprises at least one retaining loop.

7. A device according to claim 5 in which the belt comprises:

a. cellular foam padding; and b. vinyl coating.

* * * * *